United States Patent [19]

Warne et al.

[11] 4,203,810

[45] May 20, 1980

[54] ELECTROLYTIC PROCESS EMPLOYING ELECTRODES HAVING COATINGS WHICH COMPRISE PLATINUM

[75] Inventors: Michael A. Warne, Brewood; Peter C. S. Hayfield, Bickenhill, both of England

[73] Assignee: IMI Marston Limited, Staffordshire, England

[21] Appl. No.: 741,107

[22] Filed: Nov. 11, 1976

Related U.S. Application Data

[60] Division of Ser. No. 540,384, Jan. 13, 1975, which is a continuation of Ser. No. 371,727, Jun. 20, 1973, abandoned, which is a continuation-in-part of Ser. No. 125,956, Mar. 19, 1971, abandoned.

[30] Foreign Application Priority Data

Mar. 25, 1970 [GB] United Kingdom ..... 14417/70

[51] Int. Cl.[2] ..... C25D 5/38; C25D 5/42; C25D 5/50

[52] U.S. Cl. ..... 204/38 B; 204/37 R; 204/290 F

[58] Field of Search ..... 204/38 B, 38 S, 39, 204/290 F, 37 R; 427/229

[56] References Cited

U.S. PATENT DOCUMENTS

| | | | |
|---|---|---|---|
| 2,328,101 | 8/1943 | Rosenblatt | 204/38 B |
| 3,022,177 | 2/1962 | Fitch | 106/1 |
| 3,117,023 | 1/1964 | Tirrell | 427/229 |
| 3,177,131 | 4/1965 | Angell et al. | 204/290 F |
| 3,265,526 | 8/1966 | Beer | 427/229 |
| 3,294,654 | 12/1966 | Norman et al. | 204/38 B |
| 3,309,292 | 3/1967 | Andrews et al. | 204/39 |

FOREIGN PATENT DOCUMENTS 1147442 4/1969 United Kingdom .

OTHER PUBLICATIONS

Iridium, The Metal, Its Alloys, Chemical Compounds, and Catalytic Properties, I.N.C.O., Mar. 1965, p. 8.

*Primary Examiner*—R. L. Andrews
*Attorney, Agent, or Firm*—Cushman, Darby & Cushman

[57] ABSTRACT

A method of carrying out an electrolytic process utilizing an electrode formed of a film-forming metal having applied thereto coatings of a precious metal compound capable of decomposing upon heating, said compound being decomposed by heating, and a further layer of precious metal electroplated on to said fired compound layer.

10 Claims, 2 Drawing Figures

ELECTROLYTIC PROCESS EMPLOYING ELECTRODES HAVING COATINGS WHICH COMPRISE PLATINUM

REFERENCE TO RELATED APPLICATIONS

This application is a division of application Ser. No. 540,384 filed Jan. 13, 1975 as a continuation of application Ser. No. 371,727 filed June 20, 1973 as a continuation-in-part of application Ser. No. 125,956 filed Mar. 19, 1971 (both now abandoned). Reference is also made to application Ser. No. 371,726 filed June 20, 1973.

BACKGROUND OF THE INVENTION

This invention relates to methods of carrying out electrolysis and to electrolytic processes, and is particularly concerned with said methods using electrodes having an electrode substrate of titanium, tantalum or niobium or an alloy based on at least one of these metals, and a coating containing at least one precious metal on said substrate.

The term "electrode substrate of titanium, tantalum or niobium or an alloy based on at least one of these metals" includes an electrode substrate of which a core is of a metal which is more electrically conductive than said metals or alloys, the core being covered by said metals or alloys. Examples of more electrically conductive metals are copper and aluminium.

By "precious metal" is meant platinum group metals, silver and gold.

BRIEF DESCRIPTION OF PRIOR ART

Electrolytic processes utilising electrodes having a substrate of titanium, tantalum or niobium or an alloy based on at least one of these metals, and a coating thereon containing a precious metal, have been known and used for many years. Particular fields of use have been cathodic protection systems where inert anodes are used to cathodically protect for example steelwork exposed to natural waters such as seawater and river water. Hypochlorite cells of both mono- and bi-polar construction operating in natural seawater at up to 50° C. have been used. Other electrolytic processes include electrodialysis cells, electroflotation, metal finishing, metal electrowinning, the treatment of effluents, organic oxidation reactions, water heaters, peroxidation reactions, anodes for general use in chlor-alkali electrolysis, and more recently it is considered that titanium may be used as a substrate for a battery electrode to reduce the overall weight of the battery. Other miscellaneous uses are in specialised pieces of commercial and scientific instrumentation.

In these large numbers of uses, the requirements are often to provide a substantial thickness of coating, particularly when the use is as a cathodic protection system whereby the small but finite wear of the precious metal during use can be tolerated for many years. In this way substantial periods of time can be allowed to elapse before replacement of the cathodic protection electrode is necessary. In order to provide this substantial thickness, which may be of the order of 250 micro-inches, the precious metal has normally been electroplated directly on to the substrate. The cathodic protection anodes are frequently of a small size.

Where the electrical overvoltage properties are important, the final outer layer of the precious metal may be extremely important and the thickness of the precious metal layer relatively less important. When the electrode substrate mentioned immediately above has been prepared, there have sometimes been encountered difficulties in the process of applying thereto the electroplated layer of the precious metal. Partly because of the self-protection properties of the substrate metals or alloys, these being chosen for those very properties, it is necessary to connect the electrode substrate as the cathode in a suitable plating bath with a substantial initial voltage upon it to provide the initial electroplate coating. This forms a number of very small nodules of precious metal deposit, each nodule thereafter acting as a nucleus for further electroplate. In addition, too low a voltage upon the substrate in this plating bath will not provide enough nodules for a satisfactory uniform electroplate to be produced whilst too high a voltage produces a coating which may not have the requisite adherence to the substrate Variations in surface conditions of the titanium sheet can cause significant variations in the formation of the initial layer when using a straight electroplate without a previous painted and fired coat. This means that the electrical plating conditions are not uniform and that the change in electrode potential gives a variation in the amount of material plated across the area of the substrate. Thus, if it is required to provide a minimum thickness of electroplate material, certain areas have to have a much greater, and unnecessary, thickness of electroplate material. It has been found to be almost impossible to provide a uniform thin electroplate by methods proposed in the prior art. Not only has it been found difficult to apply coatings to large areas, but it has also been found difficult to apply coatings to complex shapes. In practice, for complex shapes and large areas, it has been found difficult to produce a straight electroplated coating of less than 100 micro-inches in thickness if a uniform plate is required.

Extensive amounts of work have gone into the investigation and preparation of suitable anodic surfaces, but the systems which were used heretofore were principally straight electroplating or painting or sometimes painting on a previously electroplated substrate. Numerous examples are to be found of these prior routes in the prior art of, for example, British Patent Specification No. 1147442 or Canadian Pat. No. 671035. It had previously been thought essential to produce an applied coating by a painting and firing route with the painted coating on the outside on top of an electroplated platinum substrate because when employed for instance as anodes in mercury cells for the electrolysis of brine, the cell voltages required for any current density above a minimum were believed to be less than the cell voltage required for an electrodeposited coating of platinum. Details of these requirements are to be found in pages 3 and 4 of Canadian Pat. No. 671035, lines 22 to 4.

OBJECT OF THE INVENTION

It is an object of the present invention to provide a method of carrying out an electrolytic process, electrolysis or cathodic protection utilising an electrode manufactured by a method in which there is produced an electroplate deposit which is more reliably reproduced, has a better adherence, and is more uniform than those manufactured by the methods described above.

It is a further object of the invention to produce an electrode having good acid resistance and a low effective porosity.

A subsidiary object of the invention is to provide a method utilising electrodes having thinner uniform coatings of electroplated precious metals than those provided utilising the methods of the prior art described above.

SUMMARY OF THE INVENTION

By the present invention there is provided a method of carrying out an electrolytic process, which comprises inserting in an electrolyte an electrode, connecting said electrode to a positive potential with respect to a cathode in said electrolyte, said electrode being manufactured by taking an electrode substrate of titanium, tantalum or niobium or an alloy based on at least one of these metals, applying thereto at least one chemical compound containing a precious metal and capable of decomposing upon firing to provide an underlayer containing the precious metal or an oxide thereof or both, firing the coating to produce such an underlayer and subsequently electroplating at least one precious metal on to said underlayer.

The paint composition may comprise chemical compounds of platinum and iridium or of ruthenium. Preferably further platinum or platinum and iridium are electroplated on to said underlayer. The surface of the electrode substrate may be cleaned and chemically or mechanically roughened prior to the application thereto of the paint composition.

If required, the electrode substrate may be provided with a primary layer of an oxide of the metal of the electrode substrate prior to the step of applying said coating of a paint composition.

If the substrate is niobium or an alloy based thereon, the paint coating is preferably fired in a non-oxidising atmosphere to prevent excessive oxidation of the substrate. If the substrate is titanium or tantalum or an alloy based thereon, the paint coating is preferably fired in an oxidising atmosphere.

If required, subsequent to electroplating at least one coating of a paint composition comprising at least one chemical compound containing precious metal and capable of decomposing upon firing to provide a further layer containing the precious metal or an oxide thereof or both, may be applied to the electroplated layer, followed by firing the coating to produce such a layer. In this way there is manufactured an electrode for electrolytic purposes having a surface with an electrical overvoltage lower than the overvoltage of the electroplated surface.

The thickness of the total layer of precious metal may be in the range 20 to 500 micro-inches and is preferably in the range 40 to 250 micro-inches. 100 micro-inches is the preferred thickness for certain uses.

Without prejudice to the present invention, it is believed that the fired underlayer containing the precious metal or an oxide thereof or both, provides a large number of evenly dispersed nodules of the metal and/or oxide, each nodule acting as a nucleus on to which said precious metal can be electroplated. In this way the electroplate process can commence with the electrode substrate at a relatively low voltage in the plating bath, and only a thin electroplate deposit can be applied if this is required. Even if a relatively thick electrode deposit is necessary, the nuclei provided by the present invention provide good adherence and a uniform deposit. The uniform deposit is because the surface condition of the substrate material does not have such a dramatic effect on the electroplateability of the precious metal and there is a much lower tendency for a thicker layer to be built up adjacent the current lead-in with a thinner layer being built up at points remote from the current lead-in.

These factors provide additional and unexpected benefits for the present invention and one which is of great technical importance is that for a titanium substrate the manufactured electrode exhibits greatly improved properties of resistance to acid attack and to undermining of the layer of electroplate when the electrolytic cell is in operation. Still greater improvements follow if two or three fired coatings of the paint composition are used. These resistance properties considerably widen the scope of economic use of titanium substrate electrodes in electrolytic processes. For niobium, there is some significant improvement in its acid resistance, but for tantalum the acid resistance is already high.

BRIEF DESCRIPTION OF THE DRAWINGS

Examples of the present invention will now be described, and details of the manufacture of the electrodes for use in the invention, will be more particularly described with reference to the accompanying drawings in which.

DESCRIPTION OF THE PREFERRED EMBODIMENTS

Before describing the electrolytic processes embodied in the present invention, the description will initially refer to the manufacture of suitable electrodes.

A number of sheets of titanium of commercial purity were etched in a 10 w/v % aqueous solution of oxalic acid at 80° C. for 16 hours and thoroughly washed in tapwater.

Each sheet was then provided with a single layer of 70/30 platinum/iridium resinate paint having a metal content of approximately 7.5 wt%. The coated sheets were heated in air firstly for 5–30 minutes at 200°–300° C. and then 10–30 minutes at 400°–550° C. This was followed by an oven treatment for 5–15 minutes at 400°–550° C. in a cracked ammonia atmosphere, followed by 4–150 hours heat treatment in circulating air at 400°–550° C. The precise temperatures and times are readily determined by simple experiment. This produced a coating about 3 micro-inches in thickness of platinum and iridium in the proportions 70:30, although some of the iridium may be present as an oxide rather than as a metal.

A first set of the painted sheets was immersed as cathodes in a conventional sodium hexahydroxyplatinate bath to provide an average platinum coating thickness of 30 micro-inches. The coated surfaces had an acceptably uniform silvery appearance and were free of stain.

A second set of the painted sheets was electroplated in the same way as that described above, but provided with a thicker coating of platinum, which was about 50 micro-inches in thickness.

Figure 1:
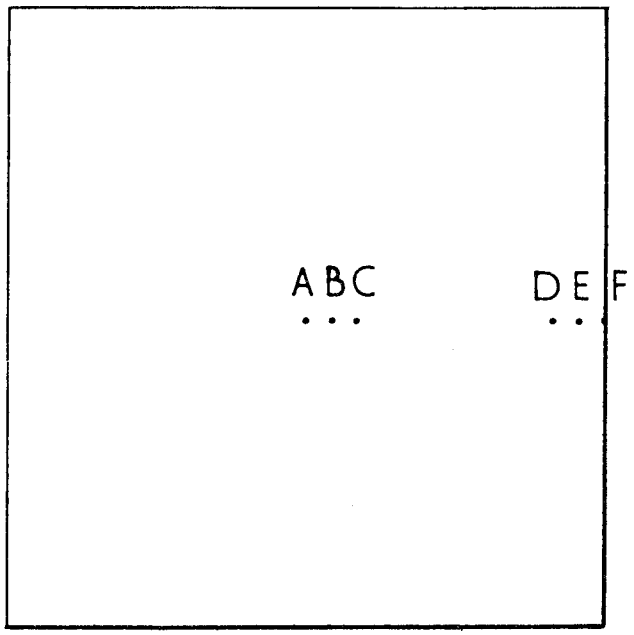
FIG. 1 shows a sheet electrode.

Referring to FIG. 1, thickness measurements were taken at various locations on the surfaces of representative sheets 1 and 2 from the first and second sets respectively in order to check the uniformity of the thickness of the electroplate. Each sheet 1,2 was 600 mm square and Table 1 give the thicknesses measured using a conventional beta backscatter gauge at the locations on that plate A to F. These locations are shown in FIG. 1, and are all on a mid-line on the respective sheet, A being on its centre with B and C respectively 25 and 50 mm away therefrom towards one edge, F being at the edge of the sheet with locations E and D being respectively 25 and 50 mm away therefrom towards the centre of the sheet. The uniformity of thickness is evident from Table I.

TABLE I

| Sheet on Test | Position A | B | C | D | E | F |
|---|---|---|---|---|---|---|
| Sheet 1 (nominal 30 micro-inches) | 29.5 | 30.5 | 30.7 | 28.5 | 32 | 28 |
| Sheet 2 (nominal 50 micro-inches) | 48 | 48 | 49 | 47.5 | 46.5 | 47 |

Sheets 1 and 2 were also tested for resistance to acid undermining of the electrodeposit by being immersed in concentrated hydrochloric acid at 20° C. Periodically they were removed, washed in tapwater, dried in a stream of air, and assessed for adhesion by the application thereto of a strip of the self-adhesive tape available under the trade mark "Sellotape", which is snatched or removed quickly therefrom. It has been found that this is a reliable gauge of the expected adhesion of the coating when the electrode is in service.

The results of this test are given in Table II, together with comparative results obtained from titanium sheets 3 and 4 which were electroplated with the greater thickness of 100 micro-inches of platinum but with no paint coating, and an all-painted ti anium sheet 5. Sheet 5 had about 10 micro-inches of 70/30 platinum/iridium applied by four subsequent painting treatments as described above, except that the 4–150 hours heat treatment was only used when all four paint applications and firings had been finished.

TABLE II

| Sheet on Test | Behavior of coating on immersion in concentrated hydrochloric acid at 20° C. |
|---|---|
| Sheet 1 | Slight uniform loss after 300 hr. and still extensive adherent coating after 500 hr. when test stopped |
| Sheet 2 | |
| Sheet 3 | Extensive loss after 62 hr. Completely stripped after 247 hr. |
| Sheet 4 | Extensive loss after 223 hr. |
| Sheet 5 | Heavy loss of coating after ½ hour. Completely stripped after 1 hr. |

The results of Table II show that although the paint underlayer lies beneath platinum electroplate, it has a major effect upon the life of that electroplate even compared with the much thicker electroplate coatings of Sheets 3 and 4. This is of greater surprise when considering the results of Sheet 5 where an all-painted surface had very little useful life.

Figure 2:
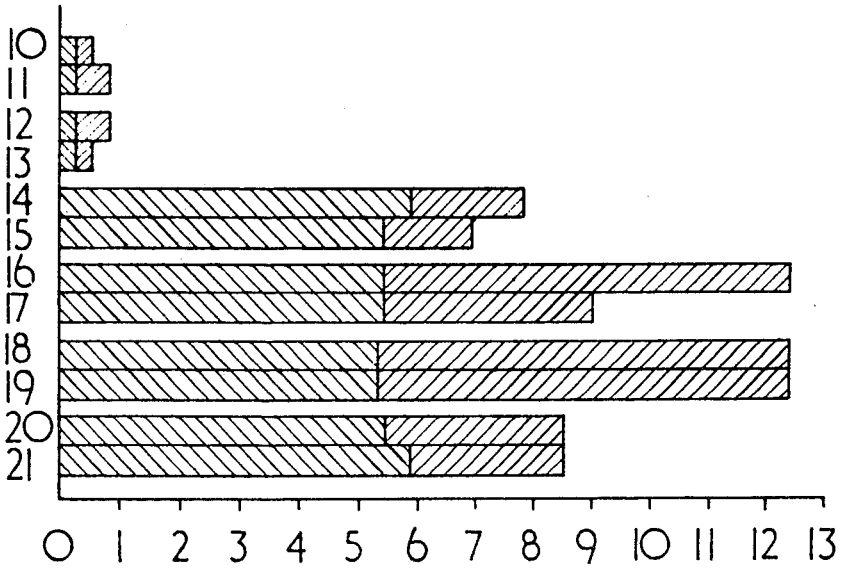
FIG. 2 represents a bar chart showing comparative experimental results of electrode life.

The acid undermining resistance tests reported above in relation to Table II were extended with the results shown in FIG. 2. FIG. 2 is a bar chart showing the lives in time units along the horizontal scale of further example electrodes 10,12,14,16,18 and 20 and corresponding confirmatory similar electrodes 11,13,15,17,19 and 21. The electrodes are immersed in concentrated hydrochloric acid at 20° C. and coating adhesion tested by the "Sellotape" test described above. The first shading of each bar indicates that the coating was intact upon testing, the second shading indice that parts of the coating were removed upon testing although the electrode was still functional and could be used as an electrode with little change in overvoltage, and the end of the bar shows the end of useful electrode life.

Electrodes 10 and 11 were produced by oxalic acid etching a titanium substrate as described above, and electroplating about 100 micro-inches of platinum from a conventional sodium hexahydroxyplatinate bath.

Electrodes 12 and 13 were produced in the same way as electrodes 10,11 except that etching was carried out with hydrochloric acid. Electrodes 10–13 have no paint coatings and represent the prior art acknowledged above.

Electrodes 14 and 15 were produced by the oxalic acid etch of electrodes 10,11, followed by two paint coatings of 70:30 platinum iridium as described above, followed by the electroplate of electrodes 10,11 of about 100 micro-inches in thickness. The only difference between electrodes 10,11 and 14,15 is the paint underlayer, but just comparing the lives of intact coatings of electrodes 10 and 14, there is a factor between them of about 23.

Electrodes 16 and 17 were produced in the same way as electrodes 14 and 15 except that before the paint coating there was applied a layer of titanium dioxide.

Electrodes 18 and 19 were produced in the same way as electrodes 14 and 15 except that the paint coatings were applied using a paint composition containing ruthenium, whereby there is produced an underlayer principally of ruthenium oxide. The cracked ammonia and subsequent air treatments can be omitted. The only difference between electrodes 10,11 and 18,19 is the paint underlayer, but just comparing the lives of intact coatings of electrodes 10 and 18 there is a factor between them of about 21.

Electrodes 20 and 21 were produced in the same way as electrodes 18 and 19 except that before the paint coatings there was applied a layer of titanium dioxide.

In modifications of electrodes 14–21 the electroplated platinum layer can be replaced by a more durable electroplated alloy layer of platinum and iridium, preferably in the relative proportions of 70:30 respectively.

Sheets 1 and 2 were also assessed for chlorine overvoltage in flowing 22 wt% sodium chloride at 70° C. Varying current densities were used and satisfactory overvoltages were measured. Details are given in Table III together with those from sheets 3 and 5 mentioned above. The electrodeposit on the finely nucleated painted surface of sheets 1 and 2 produces lower chlorine overvoltages than the all-electroplate comparative sheet 3.

TABLE III

| Sheet on Test | Overvoltage in millivolts for current densities in kiloamp/m$^2$ 0.5 | 1.0 | 5.0 | 10.0 |
|---|---|---|---|---|
| Sheet 1 | 40 | 50 | 170 | 235 |
| Sheet 2 | 320 | 400 | 500 | 550 |
| Sheet 3 | 470 | 500 | 600 | 650 |
| Sheet 5 | 23 | 28 | 38 | 40 |

As deposited, the paint layer tends to craze and parts even curl at edges, even though the principal deposit adheres very strongly. On electro-deposit of platinum, fine nuclei occur uniformly over the surface, rather like frost on foliage. This means that the real surface area of the electrodeposit is greater than would occur on electroplating without the paint pretreatement, when relatively fewer and individually larger nuclei form. The increase in real surface area gives rise to a lower characteristic overvoltage for anodic discharge of gases whether oxygen, chlorine, or other gases.

The electrolytic processes in which electrodes of the type described above can operate can utilise a wide range of electrolytes. The electrolytes are preferably near neutral but may range in pH from about 2.0 (about 2.5 in mercury type chlorine cells) to about 10. However, pHs outside this range can also be accommodated by the present invention. Temperatures up to 100° C. can also usefully be accommodated. The electrolytes may include sulphuric acid, nitric acid, phosphoric acid, river water, seawater, boiler water etc. A particular advantage of the present invention is that it may utilise chloride-containing waters including strong brine. It is inadvisable, however, to use electrolytes containing an acid fluoride.

More specific areas of application include cathodic protection, that is the use of inert anodes for the cathodic protection which is the mitigation or prevention of corrosion, of steelwork exposed primarily to natural waters such as seawater and river water. Examples include condenser boxes, strainer boxes, ducting carrying cooling or process waters, storage tanks, ships' hulls, drilling platform supports, and jetties. In all situations, the route of the present invention offers advantages in terms of improved coating adhesion and uniformity of thickness and ultimately of longer life than electrodes made by the routes employed hitherto. In the many marginal areas of application, which might lead to restricted electrolyte flow and acid conditions developing, for example anodes becoming covered with deposit, either from excessive deposition of impurity anodic oxidation products, or sifting over from changes in tidal conditions, the improved resistance to acid undermining of the coating when compared to prior art anodes is an asset. This is particularly the case where anodes are deliberately set into the ground, for example when used in connection with the protection of steel structures adjacent a coastline or riverline, for the protection of overland pipelines and ground beds for the protection of base steel storage tanks. In the majority of these applications, the current density of operation of the anode prepared by the route of the present invention, would be up to approximately 150 amps/sq ft. There is a growing tendency, however, for the ship electrodes of the invention to operate up to an appreciably higher current density, eg up to 500 amps/sq ft.

The electrolytic process of the present invention may be a hypochlorite cell and the anodes of the invention are particularly useful in hypochlorite cells of both mono- and bi-polar construction, and for operations up to 500 amps/sq ft current density. Whilst the majority of hypochlorite cells operate on natural seawater at up to 50° C., there is a growing use of the process in land based units where a wider range of electrolyte composition may be used, including more concentrated salt solutions. In multi bi-polar construction, the lower chlorine overvoltage of the present invention cells when compared to straight electroplated cells, leads to a reduction in cell voltage and hence an improvement in power efficiency.

Further uses of the present invention are in electrodialysis cells and in electroflotation cells. Such cells often involve very large electrodes up to 1 $m^2$ and greater. Whilst the chief advantage of the present invention is in the manufacture of uniformly coated anodes for such cells, nevertheless the improved resistance to acid undermining is beneficial in that often it is necessary to operate in practice with slightly acidified electrolyte around the electrodes, or periodically to acidify the cell.

The electrolytic process may be electro-etching or electroplating in warm to hot acid or alkaline environments, as for example in the metal finishing industry. There is a wide use of anodes in gold, rhodium, silver, and nickel electroplating using current densities up to 100 amps/sq ft. Prior to the present invention, there had been a recurring problem of acid undermining of platinised titanium anodes of the prior art, and the number of prematurely failed anodes has now been significantly decreased by the introduction of the present invention.

The electrolytic process of the present invention may be metal electrowinning, including the large industry of basic metal retrieval by electrowinning, but also including the more marginal applications such as cells for the recovery of metal from dilute solutions, eg spent pickling liquors. Such liquors include copper sulphate in a dilute sulphuric acid solution, spent photographics solutions incorporating silver, and the like. As in the metal finishing applications, the electrolyte is most usually acidic and warm. Thus, in a great many electrowinning applications, the electrolyte may be sulphuric acid in the concentration range 25 up to 200 gms/liter at temperatures up to 50° C. Current densities of operation may be up to 200 amps/sq ft. The advantage of the present invention is the resistance to acid undermining and significantly lower chlorine overpotential compared with the platinum electroplated surfaces used hitherto. The electrodes may well have a further fired painted surface on top of the electroplate and this surface may be heat treated if required.

Effluents may be treated by the present invention when gas is anodically evolved, the gas usually being chlorine, and the chlorine degrading products within the electrolyte stream as for example in hypochlorite cells. However, direct anodic reaction of other ions may take place, eg the oxidation of cyanides and various organic species. The electrolytes may well be acidic and the advantages of resistance to acidic undermining mentioned above apply once more.

The electrolytic proces may be an organic oxidation reaction wherein there is a direct electrochemical reaction at the anode in an organic electrolyte, the principal reaction being an anodic oxidation or a cathodic reduction. In either situation, it is desirable to have a stable inert anode and the electrolytic processes using anodes of the type herein described are advantageous over conventional electroplate constructions. For all such applications, the anolyte may be acidic or alkaline and may be at a moderate to high temperature. The anode formed by taking the substrate with its painted, fired and electroplated precious metal, may be heat treated at a high temperature to give a particularly uniform intermetallic noble metal/titanium surface with no residual islands of differing composition. For high efficiencies of operation, it is very desirable to start with a uniform electrochemical potential surface. Intermetallic coatings of this type have a particular advantage of possessing high overvoltages.

The electrodes of the present invention may be used in water heaters where, for the optimum resistance to scale formation, a particularly desirable property of AC water heaters is a very high quality mirror-like surface finish on the electrodes. This may be achieved by first forming a paint/electroplate route in the processing stage utilising only very lightly etched titanium prior to coating so that on subsequent processing including rolling or drawing or some other mechanical operation to smooth the surface, an improved final finish can be obtained. Preferred coatings of electrodes prepared by this route would be rhodium and 70/30 platinum-/iridium.

The electrolytic process of the present invention also includes peroxidation reactions. For such applications, for example the formation of persulphate, perchlorate, perborate, a particular requirement of the anode is a high overpotential. Methods of construction can involve routes as described above with reference to the water heaters. For these aplications, platinum as well as the other noble metal electrodes referred to in connection with the water heaters can be used.

Chlor-alkali electrolysis is also an electrolytic process which can be performed by the present invention. Because the chlorine overvoltage of the paint electroplate surface is high compared with coatings prepared by painting alone, electrodes prepared by the paint/electroplate route are slightly less likely to be used than straight painted electrodes at the present time. They would, however, function economically in diaphragm-type chlorine cells and chlorate cells, especially if the electroplate were platinum/iridium.

The electrolytic process may be a battery, for example a lead acid battery may use titanium as a lightweight support for the positive plate. Because the electrolyte used is frequently fairly strong sulphuric acid, say 40%, then even though the titanium is made anodic and therefore becomes anodically protected, sufficient attack occurs to the titanium to decrease the electrical contact between the lead and lead salts and the titanium support grids. Under such circumstances, it has been found helpful to interpose a gold coating which can with advantage be electroplated using the paint fired electroplate route of the present invention. Such gold layers have been effectively deposited using both gold and 70/30 platinum/iridium paint precoats.

Further electrolytic processes could be the measurement of environmental parameters such as those used in probes towed behind ships for the continuous measurement of salinity and electrodes for scientific equipment to replace pure platinum or platiniced platinum electrodes used hitherto, eg platinum gauzes used in the analysis of copper.

What is claimed is:

1. A method of carrying out an electrolytic process, which comprises inserting in an electrolyte, an electrode, connecting said electrode to a positive potential with respect to a cathode in said electrolyte, said electrode being manufactured by taking an electrode substrate of titanium, tantalum or niobium or an alloy based on at least one of these metals, applying thereto at least one chemical compound containing platinum or an alloy thereof and capable of decomposing upon firing to provide an underlayer contaning platinum or an alloy thereof, firing the coating at a temperature in the range 200°-550° C. to produce such an underlayer and, subsequently, without heating to higher temperatures, electroplating at least one precious metal onto said underlayer.

2. The method of claim 1 wherein the alloy of platinum is a platinum-iridium alloy.

3. The method of claim 2 wherein the platinum-iridium alloy is a platinum 30 weight % iridium alloy.

4. The method of claim 1 wherein platinum is electroplated on to said underlayer.

5. The method of claim 1 wherein an alloy of platinum and iridium is electroplated on to said underlayer.

6. The method of claim 1 wherein the surface of the electrode substrate is cleaned and chemically or mechanically roughened prior to the application thereto of said at least one chemical compound.

7. The method of claim 1 wherein the electrode substrate is provided with a primary layer of an oxide of the metal of the electrode substrate prior to the step of applying said coating of a paint composition.

8. The method of claim 1 wherein subsequent to electroplating at least one precious metal, there is applied to the electrode substrate at least one coating of a paint composition comprising at least one chemical compound containing a precious metal and capable of decomposing upon firing to provide a further layer containing the precious metal or an oxide thereof or both, followed by firing the coating to produce such a layer.

9. The method according to claim 1 wherein subsequent to electroplating, the layer is subjected to mechanical and/or heat treatment.

10. The method according to claim 8 wherein subsequent to the firing of the coating, the electrode is subjected to heat and/or mechanical treatment.

* * * * *